US007854710B2

(12) United States Patent
Liang

(10) Patent No.: US 7,854,710 B2
(45) Date of Patent: Dec. 21, 2010

(54) MASSAGING APPARATUS FOR A MASSAGE CHAIR

(76) Inventor: Ching-Yao Liang, No. 5, Lane 205, Jen Ai St., Hsinshin Hsiang, Tainan Hsien (TW)

( * ) Notice: Subject to any disclaimer, the term of this patent is extended or adjusted under 35 U.S.C. 154(b) by 941 days.

(21) Appl. No.: 11/534,872

(22) Filed: Sep. 25, 2006

(65) Prior Publication Data

US 2008/0077060 A1 Mar. 27, 2008

(51) Int. Cl.
*A61H 15/00* (2006.01)

(52) U.S. Cl. ..... 601/98; 601/99; 601/101; 601/103

(58) Field of Classification Search ..... 601/86, 601/89–94, 97–99, 100–103, 107, 108, 110–116, 601/134, 136
See application file for complete search history.

(56) References Cited

U.S. PATENT DOCUMENTS 5,179,940 A * 1/1993 Barreiro ..... 601/99
6,071,252 A * 6/2000 Marcantoni ..... 601/115
6,790,190 B2 * 9/2004 Marcantoni ..... 601/99
6,991,609 B2 * 1/2006 Kan et al. ..... 601/99
7,022,091 B2 * 4/2006 Chen ..... 601/98
2004/0106882 A1 * 6/2004 Tseng ..... 601/86

* cited by examiner

*Primary Examiner*—Quang D Thanh
(74) *Attorney, Agent, or Firm*—Alan Kamrath; Kamrath & Associates PA

(57) ABSTRACT

A massaging apparatus comprises a frame, an elevating base, a kneading device and a pounding device. The frame is composed of a bottom base, two rails, an upper transversal rod and a threaded rod. The elevating base has two U-shaped boards symmetrically mounted at two sides thereon. A rod holder is attached to a lateral section of the elevating base to combine with the threaded rod. The kneading device comprises a first motor, divider and multiple kneading rings in pairs. The pounding device comprises a second motor, two first bearing mounts, a transmitting shaft, two pulling arms, two second bearing mounts and two pounding arms. When both motors actuate individually or simultaneously, the kneading device and the pounding device provide the kneading efficiency and the pounding efficiency respectively and at the same time.

6 Claims, 10 Drawing Sheets

MASSAGING APPARATUS FOR A MASSAGE CHAIR

BACKGROUND OF THE INVENTION

1. Field of the Invention

The present invention relates to a massaging apparatus for a massage chair, and more particularly to a massaging apparatus that has a kneading device and a pounding device respectively driven by two motors to reduce cost of gear boxes.

2. Description of Related Art

A conventional transmitting device for a massaging apparatus comprises a base made of a gear box containing a gear set and two belt wheels respectively mounted on upper and lower ends of the base, wherein the two belt wheels are driven by a motor. The belt wheels on the upper and lower ends of the base respectively drive an upper transmitting shaft and a lower transmitting shaft both connecting to a massaging wheel assembly, wherein the upper transmitting shaft drives two rolling arms in the massaging wheel assembly to provide a kneading efficiency and the lower transmitting shaft drives a pulling arm and then the rolling arms in the massaging wheel assembly to provide a pounding efficiency.

When the upper transmitting shaft is driven, the massaging wheel assembly provides the kneading efficiency. When the lower transmitting shaft is driven, the massaging wheel assembly provides the pounding efficiency. When both the upper and lower transmitting shafts are driven, the massaging wheel assembly provide both kneading and pounding efficiency at the same time.

According to the conventional transmitting device, the pulling arm and the rolling arms make the massaging wheel assembly to provide the kneading and pounding efficiency. However, the movements are achieved with the gear set in the gear box driven by two motors. The attachment of the gear set in the gear box increases manufacture cost of the massage device and reduces the utility of the massage device.

According to above description, the conventional massage device still has some drawbacks that all manufacturers are eager to resolve.

SUMMARY OF THE INVENTION

A main objective of the present invention is to provide a massaging apparatus for a massage chair that has a kneading device and a pounding respectively driven by two motors to reduce numbers of gear boxes and thus to decrease cost.

To achieve the foregoing objective, the massaging apparatus for a massage chair comprises:

a frame having a bottom base mounted with a lower bearing mount and a main motor;

two U-shaped rails respectively attached to two sides of the bottom base;

an upper transversal rod extending between two top ends of the two rails and having a middle section and an extension board with a upper bearing mount attached to the middle section; and a threaded rod pivotally and respectively connected to the lower bearing mount and the upper bearing mount;

an elevating base having two U-shaped boards with multiple rollers symmetrically mounted at two sides of the elevating base, wherein the multiple rollers are correspondingly and respectively engaged the two rails; and multiple rod holders attached to a lateral section of the elevating base and corresponding to the upper bearing mount and the upper bearing mount to be penetrated by the threaded rod;

wherein, improvements of the massaging apparatus comprises:

a kneading device mounted on the elevating base and comprising a first motor and the divider mounted to the lateral section of the elevating base opposite to the multiple rod holders; and multiple kneading rings in pairs mounted on the divider; and a pounding device mounted on the elevating base and comprising a second motor attached to the lateral section of the elevating base;

two first bearing mounts attached to the lateral section of the elevating base below the second motor;

a transmitting shaft pivotally engaged the two first bearing mounts at two ends thereof and driven by the second motor;

two pulling arms driven by the transmitting shaft;

two pounding arms respectively attached to the two pulling arms; and two second bearing mounts mounted on the lateral section of the elevating base and each engaged an upper end of the corresponding pounding arm.

By having the above structure, the kneading device and the pounding device are controlled respectively by two motors to reduce the gear box in the conventional massaging apparatus.

Further benefits and advantages of the present invention will become apparent after a careful reading of the detailed description with appropriate reference to the accompanying drawings.

BRIEF DESCRIPTION OF THE DRAWINGS

FIG. 5-1 is an enlarged cross-sectional rear view of the kneading device combined with the elevating base in partial;

DETAILED DESCRIPTION OF THE PREFERRED EMBODIMENT

Figure 1:
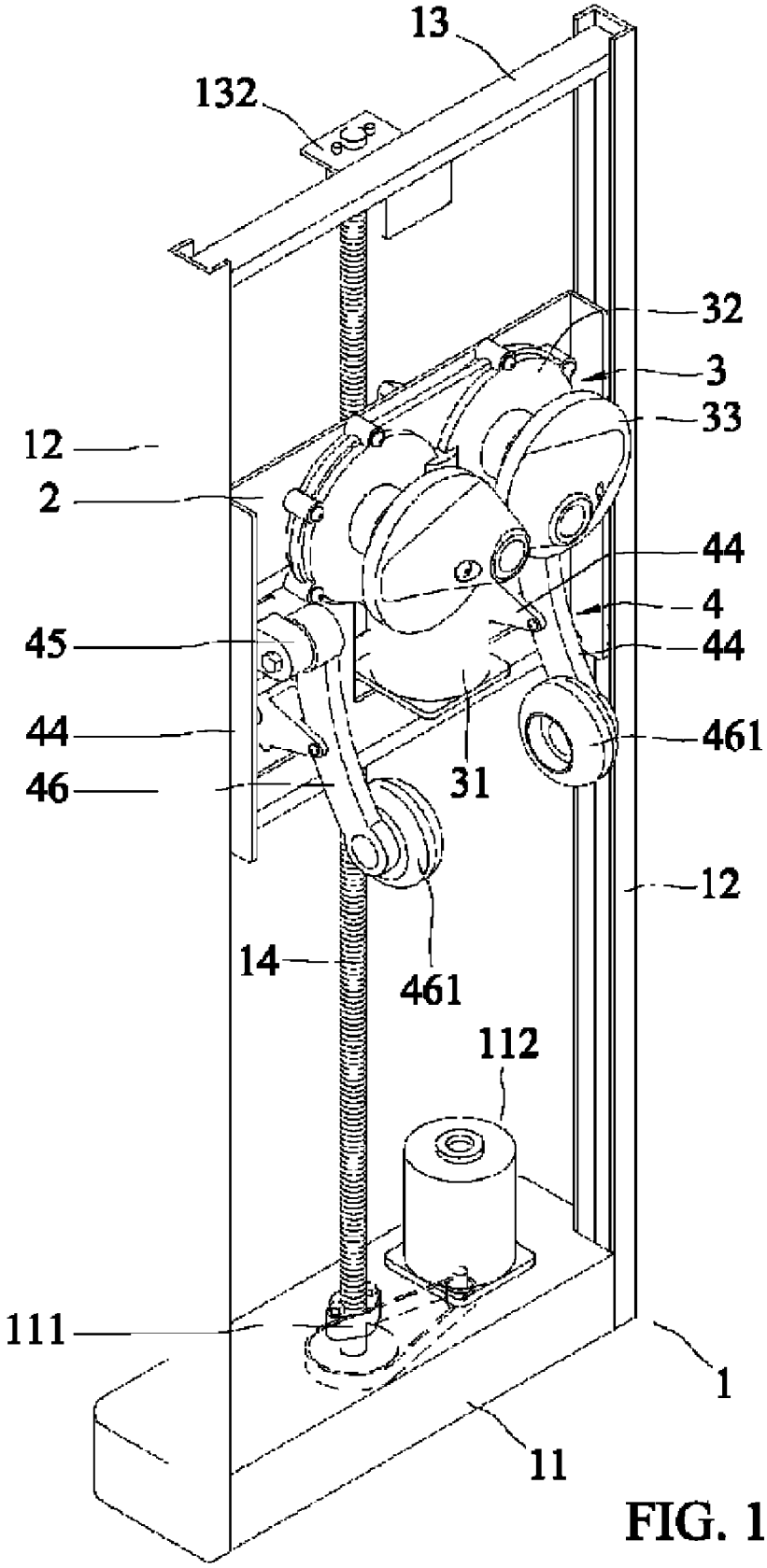
FIG. 1 is a perspective front view of a massaging apparatus in accordance with the present invention.

A massaging apparatus for a massage chair in accordance with the present invention comprises a frame, an elevating base, a kneading device and a pounding device. The frame is composed of a bottom base, two rails, an upper transversal rod and a threaded rod. The elevating base has two U-shaped boards symmetrically mounted at two sides thereon. A rod holder is attached to a lateral section of the elevating base to combine with the threaded rod. The kneading device comprises a first motor, divider and multiple kneading rings in pairs. The pounding device comprises a second motor, two first bearing mounts, a transmitting shaft, two pulling arms, two second bearing mounts and two pounding arms. When the first motor actuates, the kneading rings in the kneading device move to provide kneading efficiency. When the second actuates, the pounding arms in the pounding device move forward or backward to provide the pounding efficiency. When both motors actuate, the kneading device and the pounding device provide the kneading efficiency and the pounding efficiency at the same time.

With reference to FIGS. 1 to 4, a preferred embodiment of the massaging apparatus a frame 1, an elevating base 2, a kneading device 3 and a pounding device 4.

The frame 1 is composed of a bottom base 11, two rails 12, an upper transversal rod 13 and a threaded rod 14. The bottom base 11 has a center, a lower bearing mount 111 and a main motor 112 mounted at the center. Two U-shaped rails 12 oppositely attached to two side of the bottom base 11. The upper transversal rod 13 extends between two tops of the two rails 12 and has an extension board 132 with the upper bearing mount 131 attached to a middle section thereon. The threaded rod 14 has two ends and pivotally engages with the lower bearing mount 111 and the upper bearing mount 131 at the two ends as shown in FIGS. 4 and 5.

Figure 2:
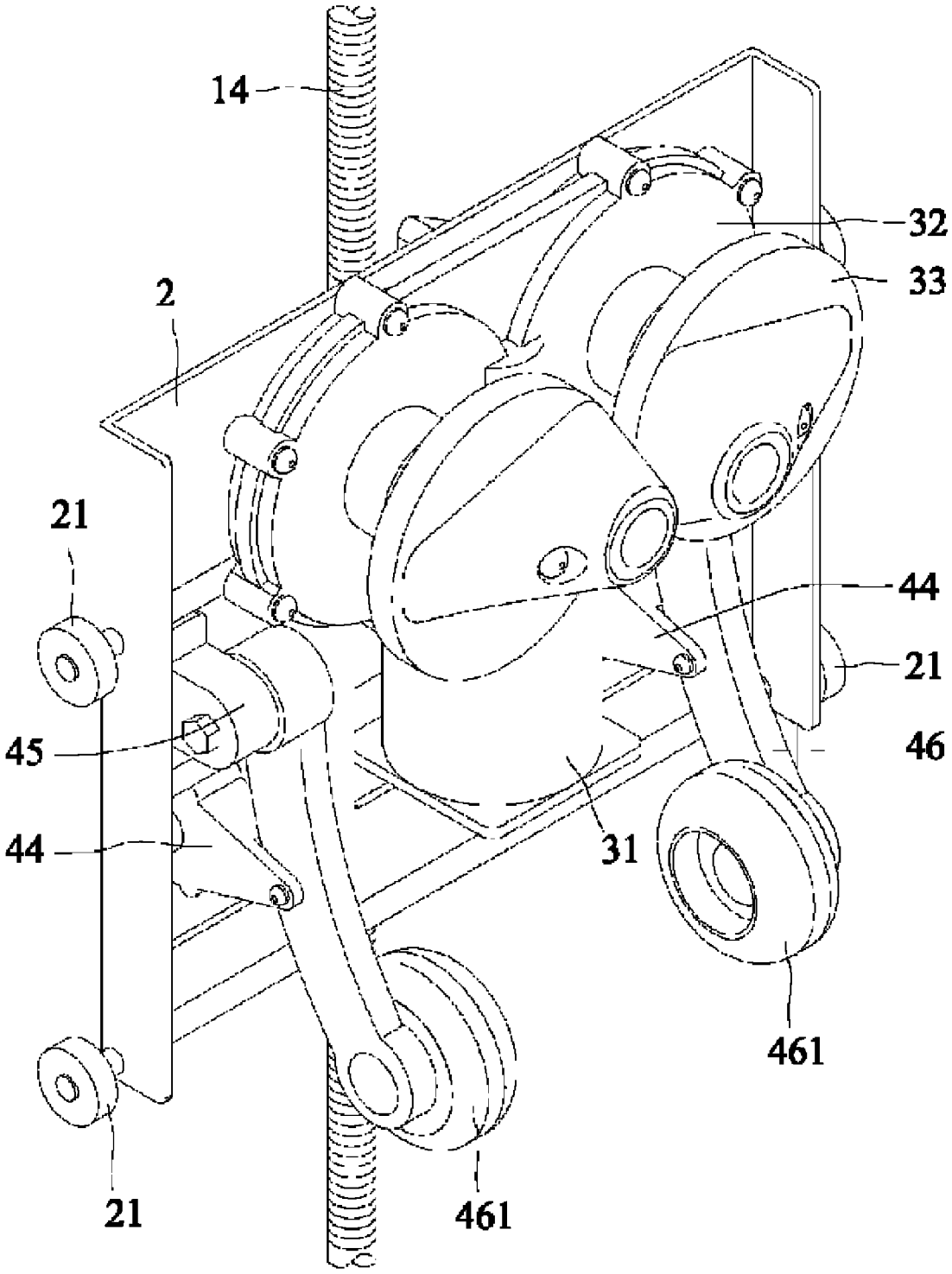
FIG. 2 is a partially enlarged perspective front view of a kneading device and a pounding device mounted on an elevating base in FIG. 1.
Figure 4:
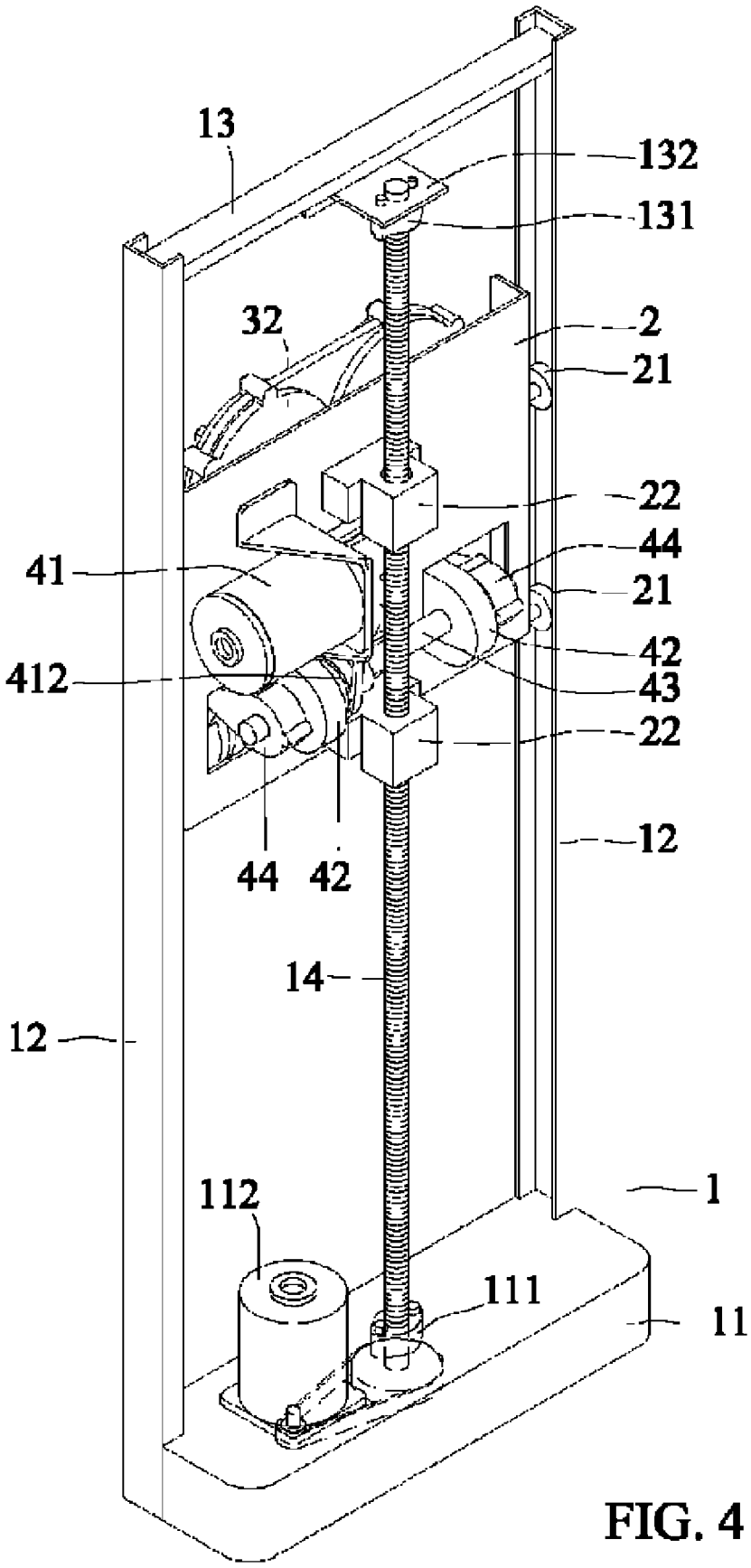
FIG. 4 is a perspective rear view of the massaging apparatus in FIG.1.

The elevating base 2 has two U-shaped boards with multiple rollers 21 symmetrically mounted at two sides of the elevating base 2 as shown in FIGS. 2 and 4. The rollers 21 on the two sides of the elevating base 2 are correspondingly and respectively engaged the two rails 12. Moreover, the elevating base 2 has multiple rod holders 22 attached to a lateral section of the elevating base 2 and corresponding to the upper bearing mount 111 and the upper bearing mount 131 so that the multiple rod holders 22 is penetrated by the threaded rod 14.

Figure 3:
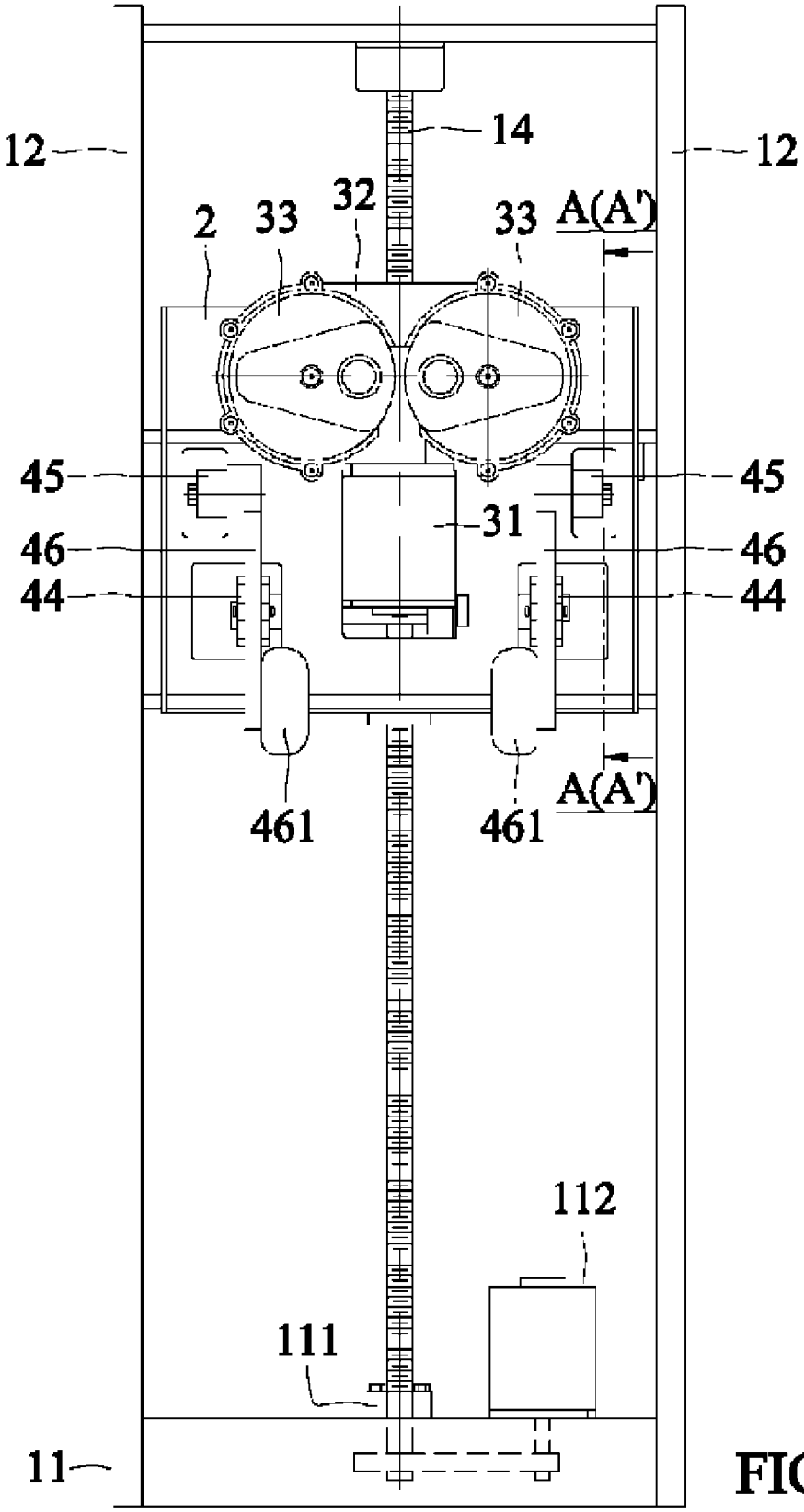
FIG. 3 is a partially cross-sectional front view of the kneading device in FIG. 2.
Figure 8:
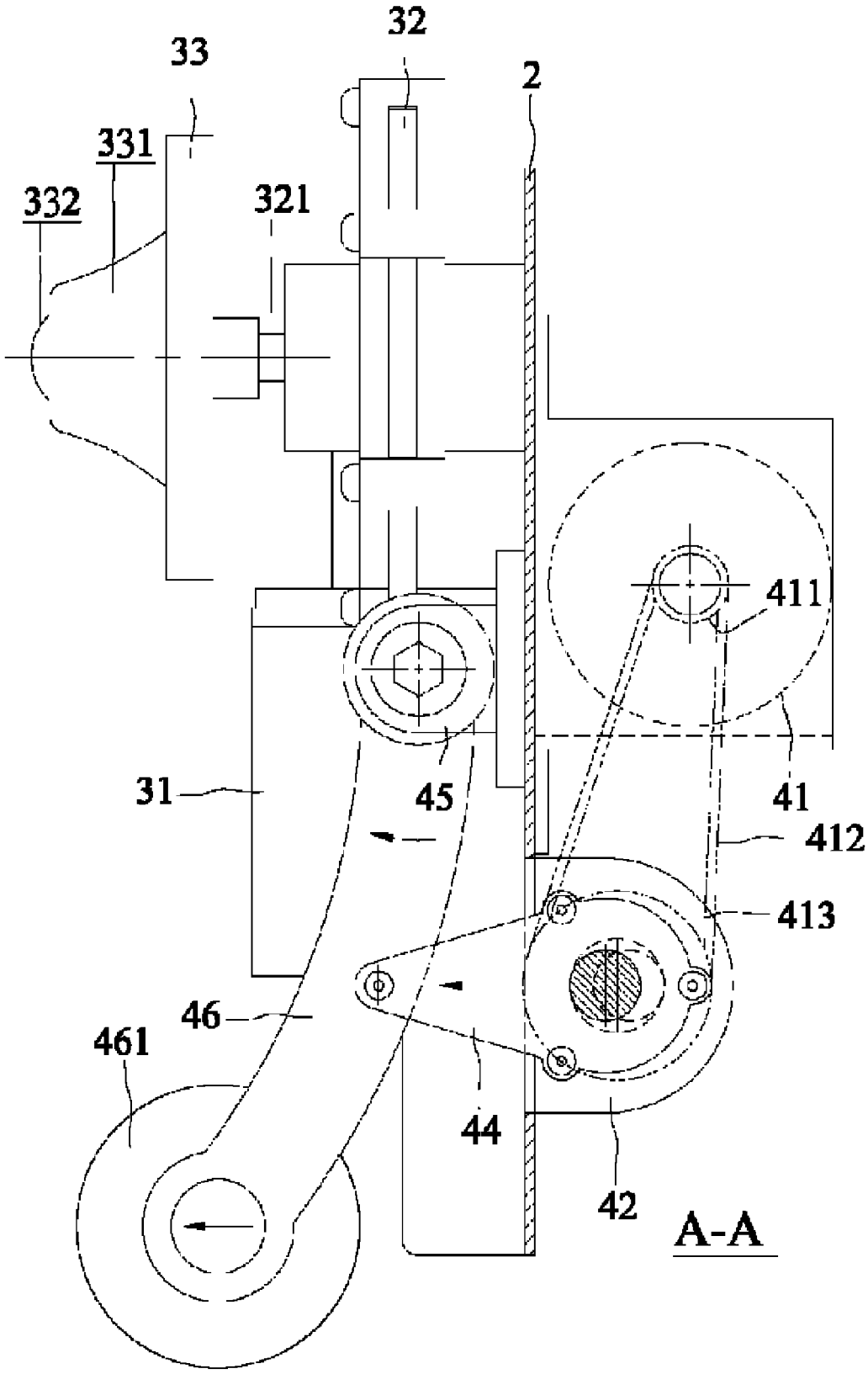
FIG. 8 is an operational side view of the kneading device, wherein two pounding arms move forward.
Figure 9:
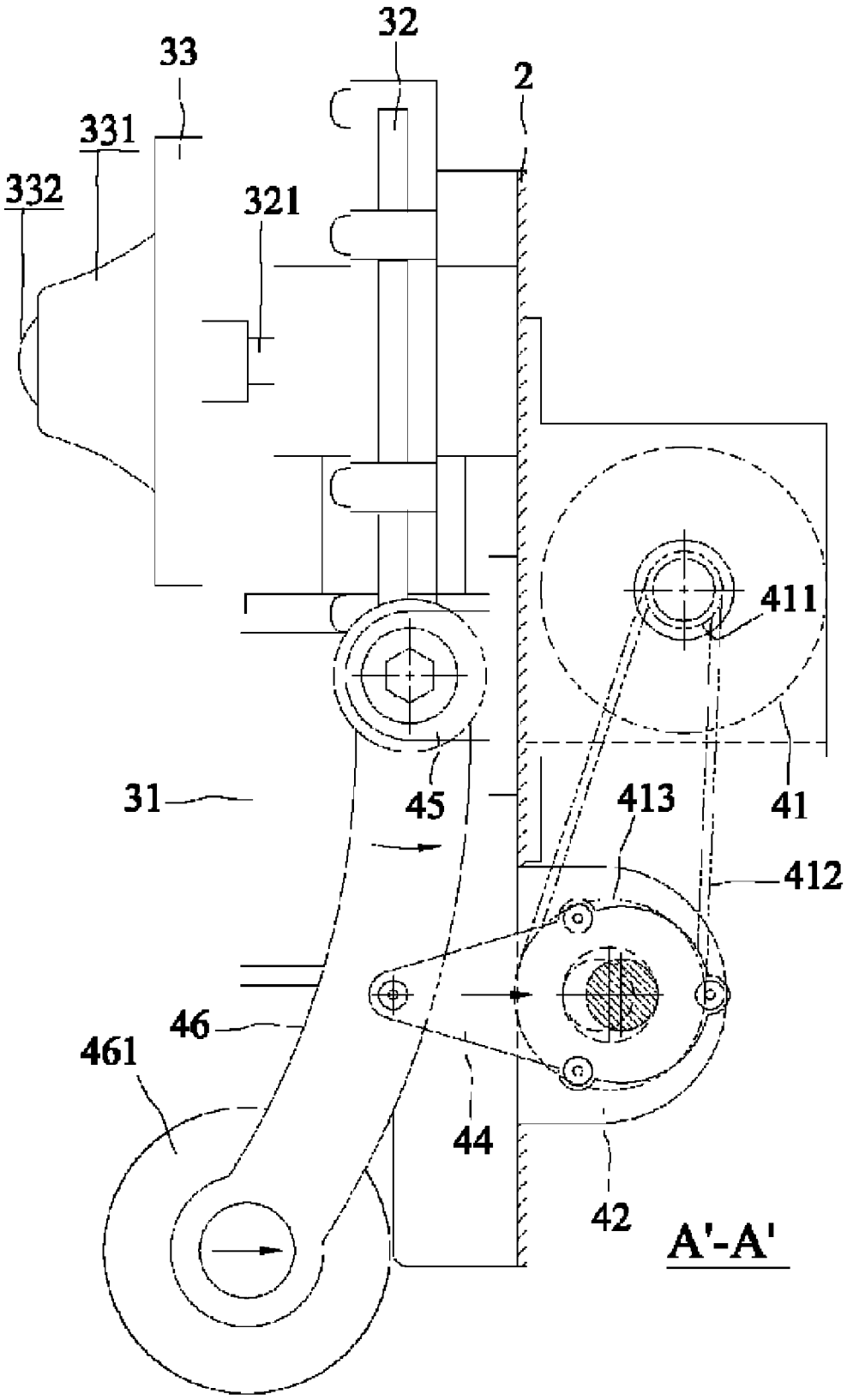
FIG. 9 is an operational side view of the kneading device, wherein the two pounding arms move backward.

The kneading device 3 comprises a first motor 31, divider 32 and multiple kneading rings 33 in pairs. The first motor 31 and the divider 32 are mounted to the lateral section of the elevating base 2 opposite to the multiple rod holders 22. Moreover, the divider 32 further has multiple rotating shafts 321 mounted on the divider 32 in the same number with the multiple kneading rings 33 as shown in FIGS. 8 and 9. Moreover, each kneading ring 33 meshes with the corresponding rotating shaft 321 to rotate oppositely when the first motor 31 actuates. Wherein, each kneading ring 33 has a protrusion 331 formed on an outer face and shaped in form of a bias truncated cone with a top and close to another protrusion 331 on the other kneading ring 33 as shown in FIGS. 2 and 3 . Moreover, a dome 332 is formed on the top of the protrusion 331 for providing hard pressing. The truncated cones are provided to avoid a use being inadvertently clamped by the kneading rings 33 and also to keep a covering cloth from being damaged or penetrated.

Figure 5:
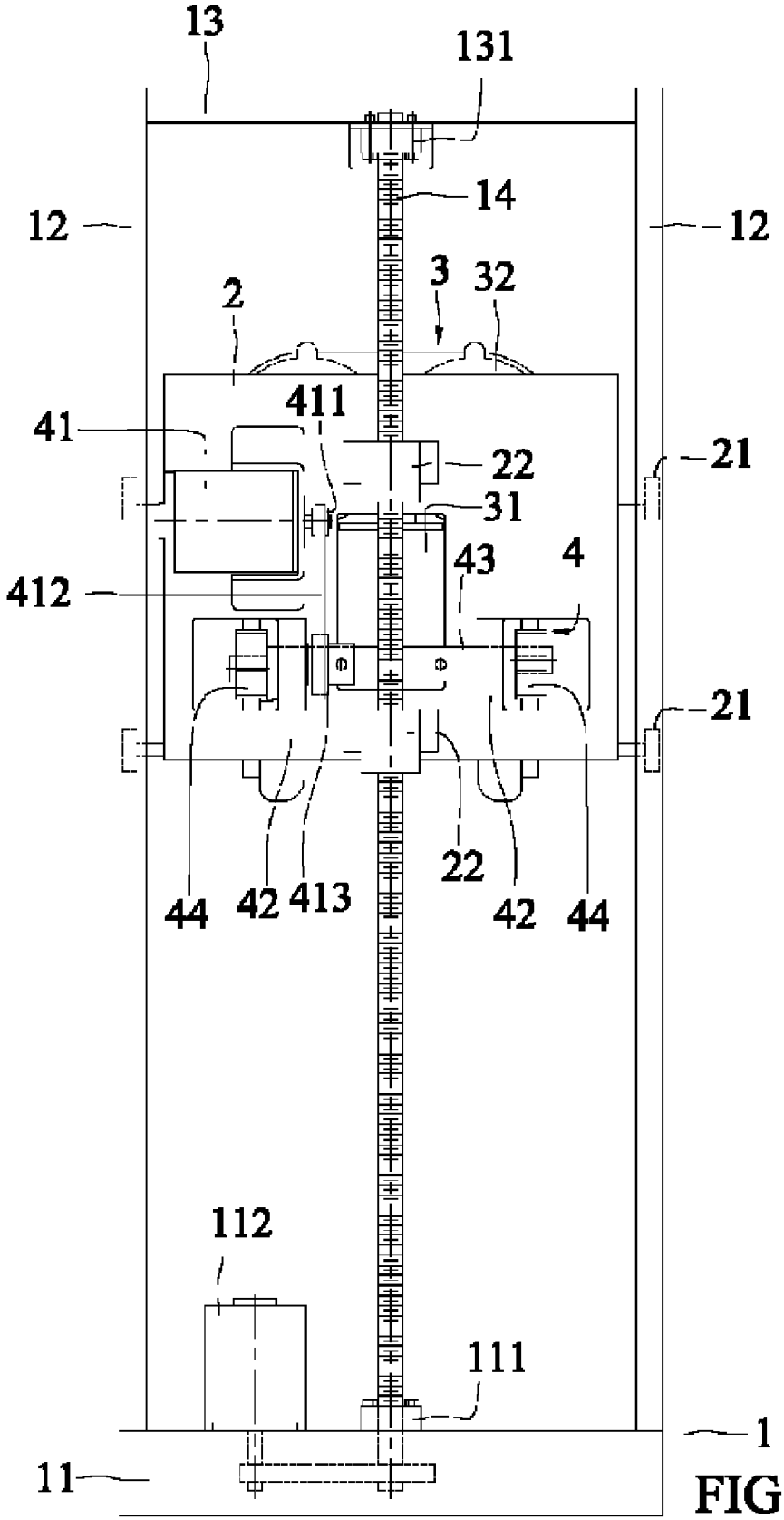
FIG. 5 is a partially cross-sectional rear view of the kneading device in FIG. 2.
Figures 1, 5:
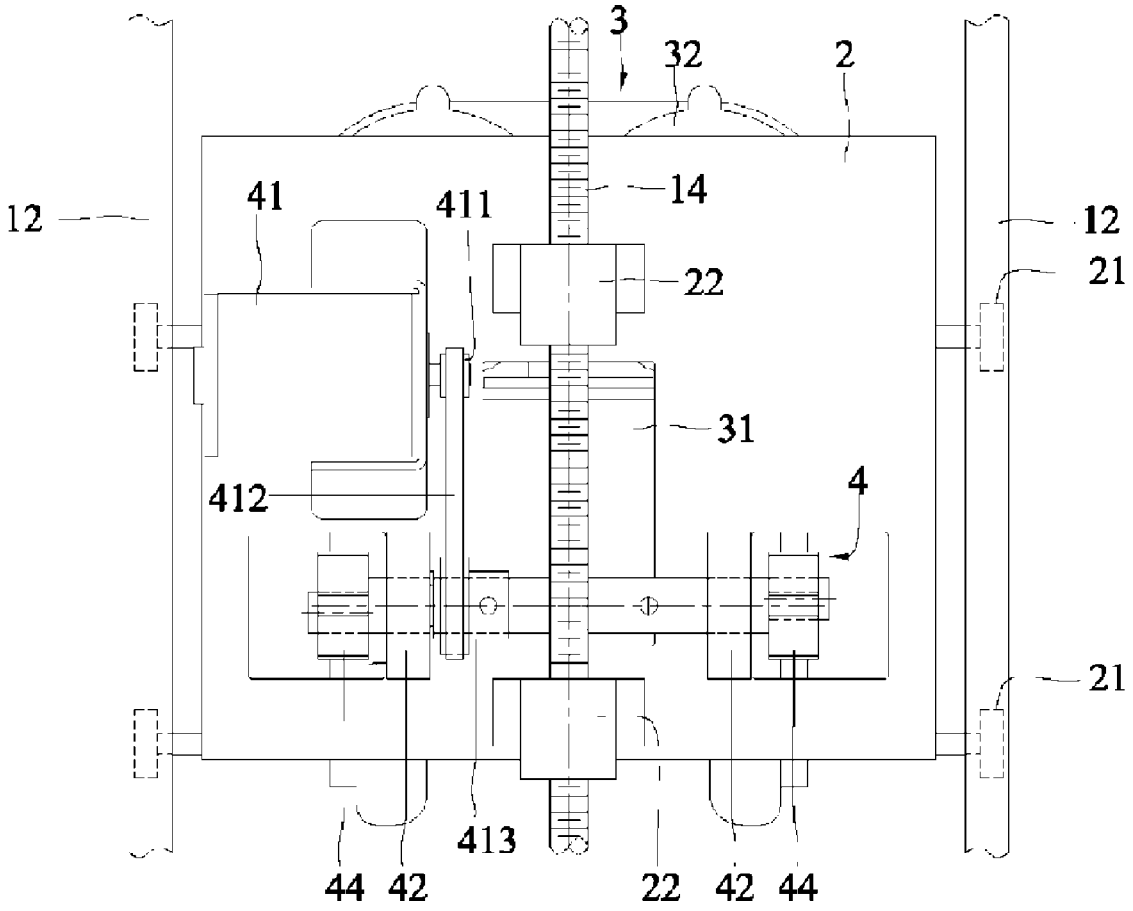
Figure 6:
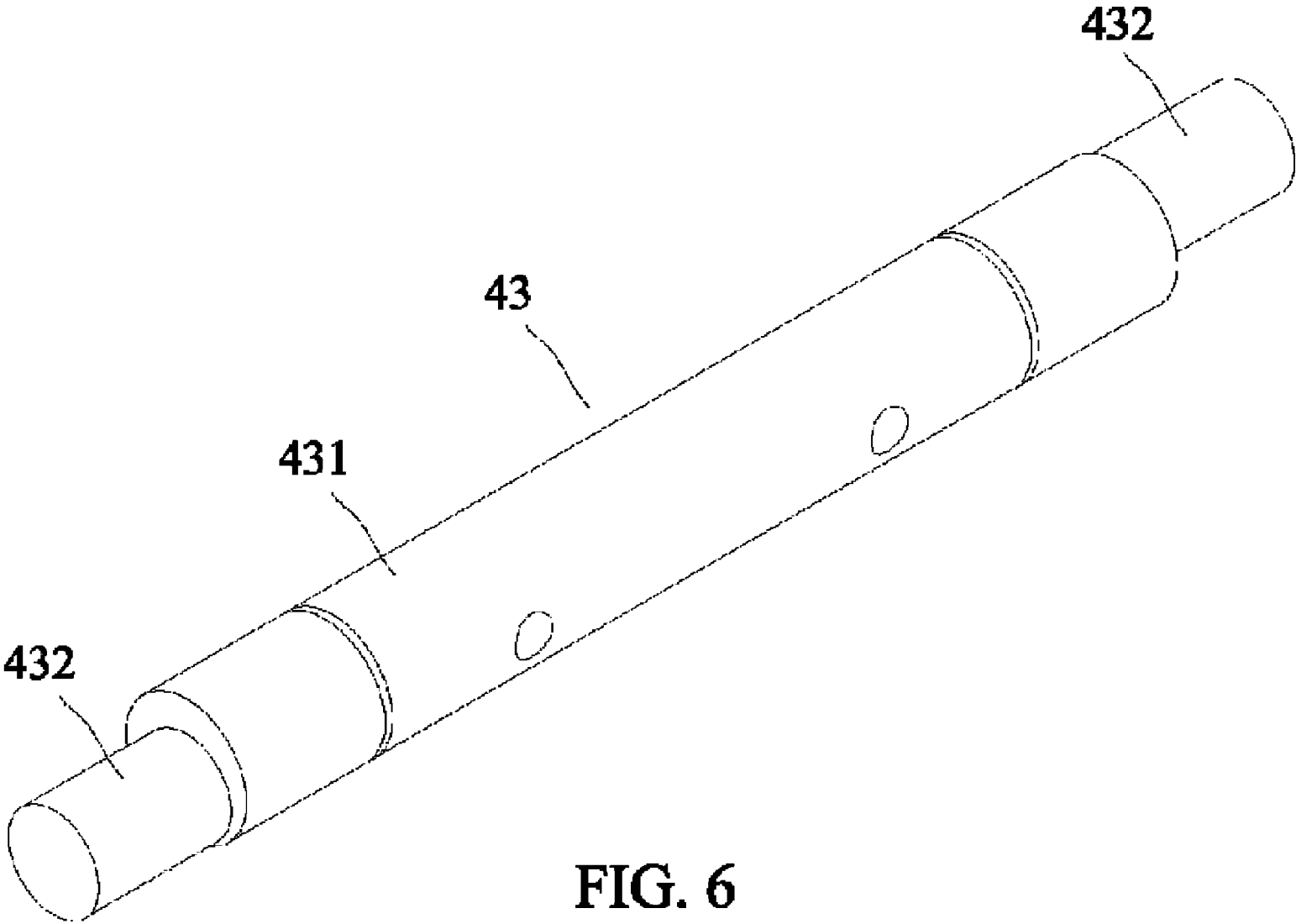
FIG. 6 is a perspective view of a transmitting shaft in the kneading device.
Figure 7:
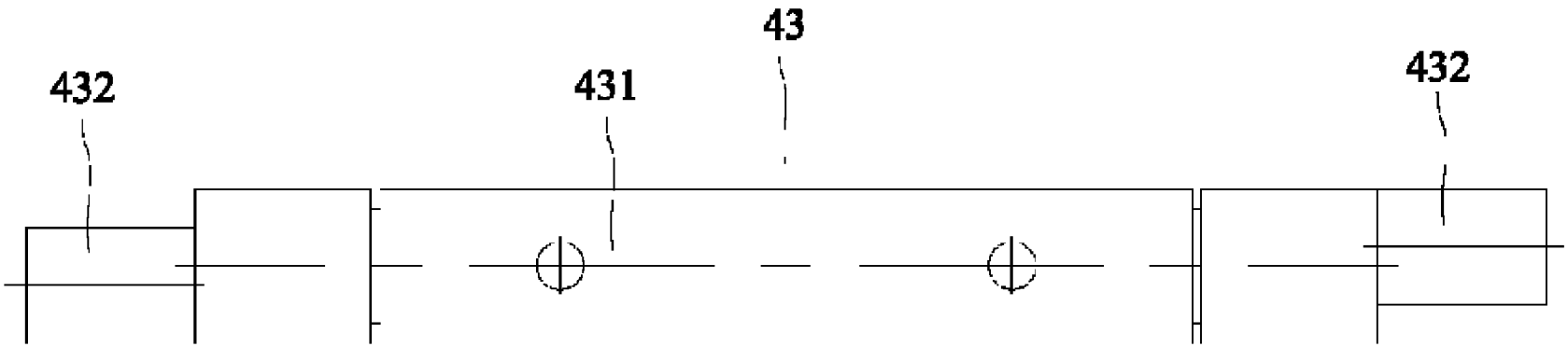
FIG. 7 is a front view of the transmitting shaft in the kneading device in FIG. 6.

The pounding device 4 comprises a second motor 41, two first bearing mounts 42, a transmitting shaft 43, two pulling arms 44, two second bearing mounts 45 and two pounding arms 46 as shown in FIGS. 3 and 5. The second motor 41 is attached to the lateral section of the elevating base 2 and has a driving wheel 411 connected with a driven wheel 413 on the transmitting shaft 43 by circling a belt 412. The two first bearing mounts 42 are attached to the lateral section of the elevating base 2 below the second motor 41. The transmitting shaft 43 pivotally engages the two first bearing mounts 42 at two ends as shown in FIG. 5-1 and has an enlarged middle section 431 and two functional pins 432 longitudinally oppositely extending from the middle section 431 as shown in FIGS. 6 and 7. Additionally, the middle section 431 of the transmitting shaft 43 is sleeved by the driven wheel 413. One end of each pulling arm 44 sleeves a corresponding functional pin of the transmitting shaft 43 and another end of the pulling arm 44 pivotally combines with a middle of a corresponding pounding arm 46. The second bearing mounts 45 are mounted on the lateral section of the elevating base 2 and respectively engaged upper ends of the pounding arms 46. Moreover, a massaging wheel 461 is mounted on a lower end of each pounding arm 46.

When the main motor 112 drives the threaded rod 14 to rotate, the elevating base 2 is driven to move upward or downward. When the first motor actuates, the paired kneading rings 33 on the kneading device 3 rotate in opposite directions to provide the kneading efficiency. When the second motor 41 actuates, the two pounding arms 46 on the pounding device 4 respectively move forward or backward as shown in FIGS. 8 and 9 because they are driven by the functional pins 432 bias from the axial central of the transmitting shaft 43. Thereby, the massaging wheels 461 provide the pounding efficiency. When the first and second motors 31, 41 actuates simultaneously, the kneading device 3 and the pounding device 4 provide the kneading and pounding efficiency at the same time.

According to above description, the massaging apparatus in the present invention has the following advantages:

1. Because the kneading device 3 and the pounding device 4 are driven by the first motor 31 and the second motor 41, the gear set in the gear boxes in the conventional massage device thus can be eliminated to save more manufacturing cost and time.

2. The middle section 431 on the transmitting shaft 43 has the two functional pins 432 bias from the axial shaft thereof, the two functional pins 432 drives the two pounding arms 46 forward or backward repeatedly to improve the pounding efficiency and utility of the massaging apparatus.

3. Because the kneading rings 33 of the kneading device 3 are driven by the first motor 31 to rotate oppositely to improve the kneading efficiency. Moreover, the protrusions 331 on the paired kneading rings 33 are shaped in a truncated cone to avoid a use being inadvertently clamped by the kneading rings 33. The truncated cone and the dome 332 on the protrusion 331 also keep a covering cloth from being damaged or penetrated and keeps the user comfortable when the massaging apparatus operates. Operational safety of the massaging apparatus is ensured.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. A massaging apparatus for a massage chair, the massaging apparatus comprising:

a frame having a bottom base mounted with a lower bearing mount and a main motor;

two U-shaped rails respectively attached to two sides of the bottom base;

an upper transversal rod extending between two top ends of the two rails and having a middle section and an extension board with a upper bearing mount attached to the middle section; and a threaded rod pivotally and respectively connected to the lower bearing mount and the upper bearing mount;

an elevating base having two U-shaped boards with multiple rollers symmetrically mounted at two sides of the elevating base, wherein the multiple rollers are correspondingly and respectively engaged the two rails; and multiple rod holders attached to a lateral section of the elevating base and corresponding to the upper bearing mount and the upper bearing mount to be penetrated by the threaded rod;

wherein, improvements of the massaging apparatus comprises:

a kneading device mounted on the elevating base and comprising a first motor and a divider mounted to the lateral section of the elevating base opposite to the multiple rod holders; and multiple kneading rings in pairs mounted on the divider; and a pounding device mounted on the elevating base and comprising a second motor attached to the lateral section of the elevating base;

two first bearing mounts attached to the lateral section of the elevating base below the second motor;

a transmitting shaft pivotally engaged the two first bearing mounts at two ends thereof and driven by the second motor;

two pulling arms connected to and driven by the transmitting shaft;

two pounding arms respectively attached to the two pulling arms; and two second bearing mounts mounted on the lateral section of the elevating base and each engaged an upper end of the corresponding pounding arm.

2. The massaging apparatus as claimed in claim 1, wherein the kneading device further has multiple rotating shafts mounted on the divider in the same number with the multiple kneading rings; and each kneading ring combines with the corresponding rotating shaft to rotate oppositely when the first motor actuates.

3. The massaging apparatus as claimed in claim 1, wherein the pounding device further has a driving wheel connected with a driven wheel on the transmitting shaft by circling a belt.

4. The massaging apparatus as claimed in claim 1, wherein the transmitting shaft has an middle section and two functional pins longitudinally oppositely extending from the middle section and bias from an axial center of the middle section.

5. The massaging apparatus as claimed in claim 4, wherein one end of each pulling arm engages a corresponding functional pin of the transmitting shaft and another end of the pulling arm pivotally combines with a middle of a corresponding pounding arm; and a massaging wheel is mounted on a lower end of each pounding arm.

6. The massaging apparatus as claimed in claim 1, wherein each kneading ring has a protrusion formed on an outer face thereof and shaped in form of a bias truncated cone with a top and close to another protrusion on the other kneading ring; and a dome is formed on the top of the protrusion.

* * * * *